US005096099A

United States Patent [19]

Wiese

[11] Patent Number: 5,096,099

[45] Date of Patent: Mar. 17, 1992

[54] DUST TIGHT SLIDE GATE ASSEMBLY

[75] Inventor: Delmar R. Wiese, Springfield, Mo.

[73] Assignee: Custom Metalcraft Inc., Springfield, Mo.

[21] Appl. No.: 558,446

[22] Filed: Jul. 27, 1990

[51] Int. Cl.[5] ..... B67D 3/00

[52] U.S. Cl. ..... 222/561; 251/326

[58] Field of Search ..... 222/559, 561, 542; 220/345; 251/326

[56] References Cited

U.S. PATENT DOCUMENTS

| | | | |
|---|---|---|---|
| 333,492 | 12/1885 | Watson | 251/147 |
| 1,449,786 | 3/1923 | Shanley | 220/861 |
| 2,227,712 | 1/1941 | Hackley | 220/314 |
| 2,387,640 | 10/1945 | Bouchelle | 222/561 |
| 2,419,182 | 4/1947 | Wells | 222/561 |
| 3,105,620 | 10/1963 | Atkins et al. | 222/561 |
| 3,255,714 | 6/1966 | Dorey | 222/542 |
| 3,344,958 | 10/1967 | Kaanehe | 222/559 |
| 3,661,357 | 5/1972 | Armstrong, Jr. | 251/326 |
| 4,541,551 | 9/1985 | Vierkotter et al. | 222/561 |
| 4,610,430 | 9/1986 | Besnard et al. | 251/326 |

*Primary Examiner*—Kevin P. Shaver
*Assistant Examiner*—Philippe Derakshani
*Attorney, Agent, or Firm*—Nies, Kurz, Bergert & Tamburro

[57] ABSTRACT

A slide gate assembly for use in maintaining a dust free environment is disclosed. The assembly includes a slide gate and a dust cover which operate to allow the passage of particulate or other material into or out of a bin or other container. In one embodiment, the gate is slidably mounted in a frame which is formed by a plate member, upper and lower base members and upper and lower gasket members. In one embodiment, some of the components are of neoprene while other components are of UHMW, thus providing resilient properties and also self-lubricating properties for the slide gate assembly. The gate assembly is maintained in a dust tight condition by means of controlled compression obtained through the use of bolts or screws which extend through the plate member, the base members and the gasket members.

9 Claims, 3 Drawing Sheets

FIG. 1
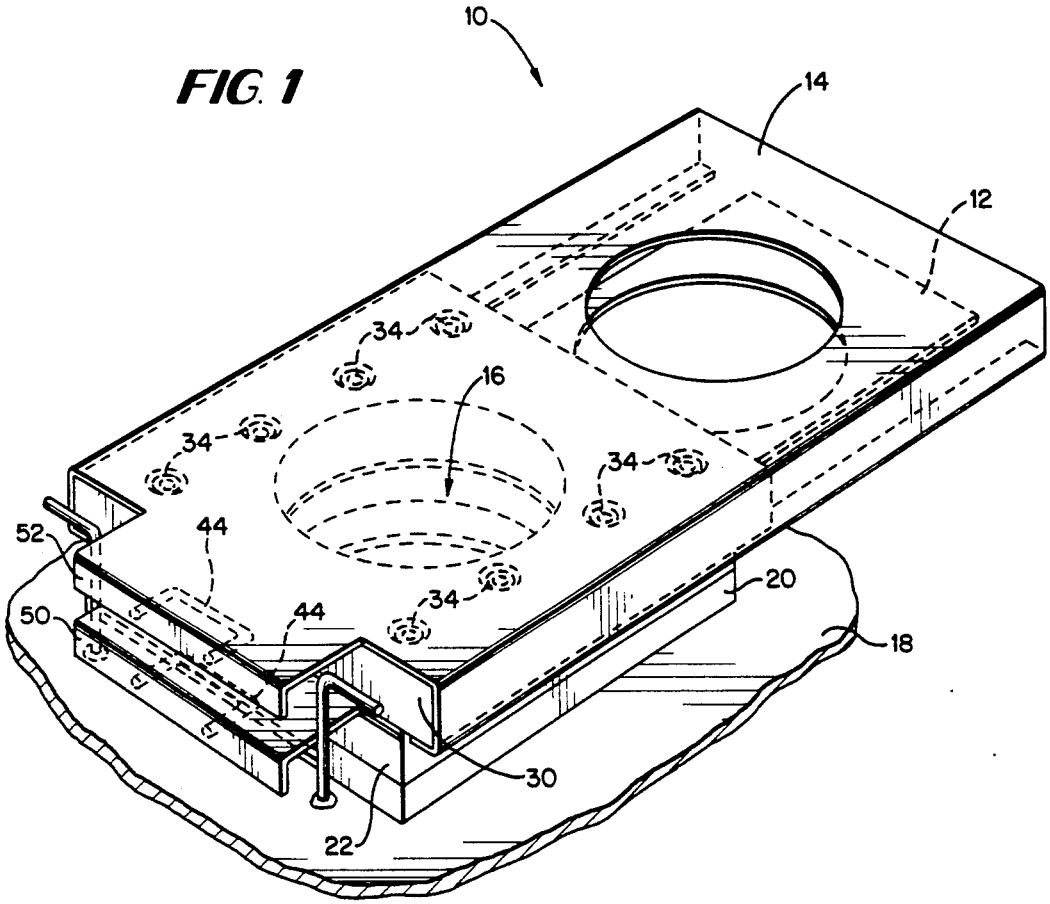
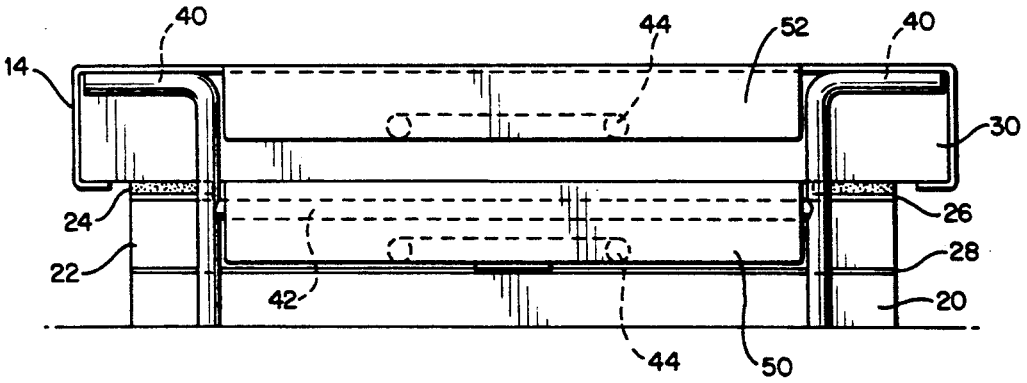
FIG. 2

DUST TIGHT SLIDE GATE ASSEMBLY

BACKGROUND AND SUMMARY OF THE INVENTION

The present invention relates to a slide gate for use in maintaining a dust free environment. More particularly, the present invention relates to a slide gate and dust cover construction which provides dust tight operation in the filling and discharge of bins and containers.

Previous slide gates and similar devices are described in the following U.S. Pat. Nos.: 333,492 to Watson; 1,449,786 to Shanley; 2,227,712 to Hackley; 3,255,714 to Dorey; 3,661,357 to Armstrong; and 4,610,430 to Besnard et al.

By the present invention, there is provided an improved dust tight slide gate assembly which can be completely removed from its associated container and reinstalled either by manual or mechanical means, thus allowing cleaning of the gate and cavity to meet specific government and pharmaceutical requirements.

BRIEF DESCRIPTION OF THE DRAWINGS

FIG. 1 is a perspective view of the dust tight slide gate assembly of the present invention.

FIG. 2 is a front elevation of the slide gate assembly of FIG. 1.

DESCRIPTION OF THE PREFERRED EMBODIMENTS

Figure 3:
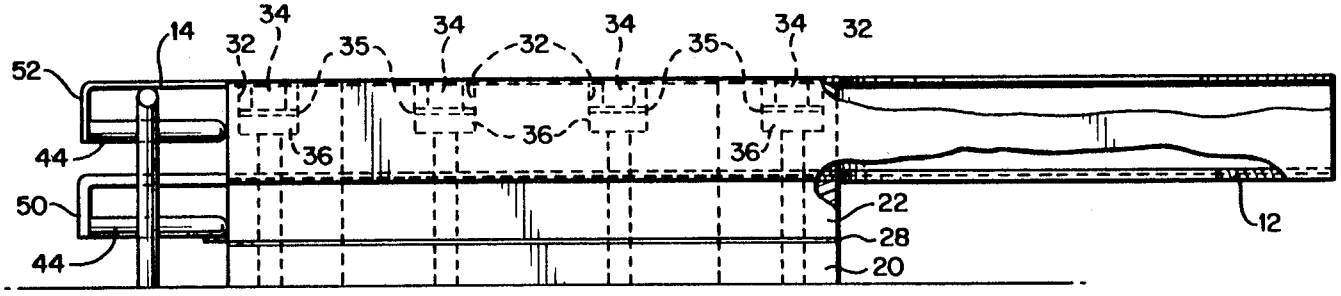
FIG. 3 is a side elevation showing the dust cover and the slide gate in the closed position.

In the embodiment of the invention as shown in FIGS. 1 through 6, there is provided a dust tight slide gate assembly 10 having a sliding gate member 12 and a dust cover 14. The slide gate assembly 10 may be installed by conventional means at an opening in any suitable bin or container 18.

Figure 6:
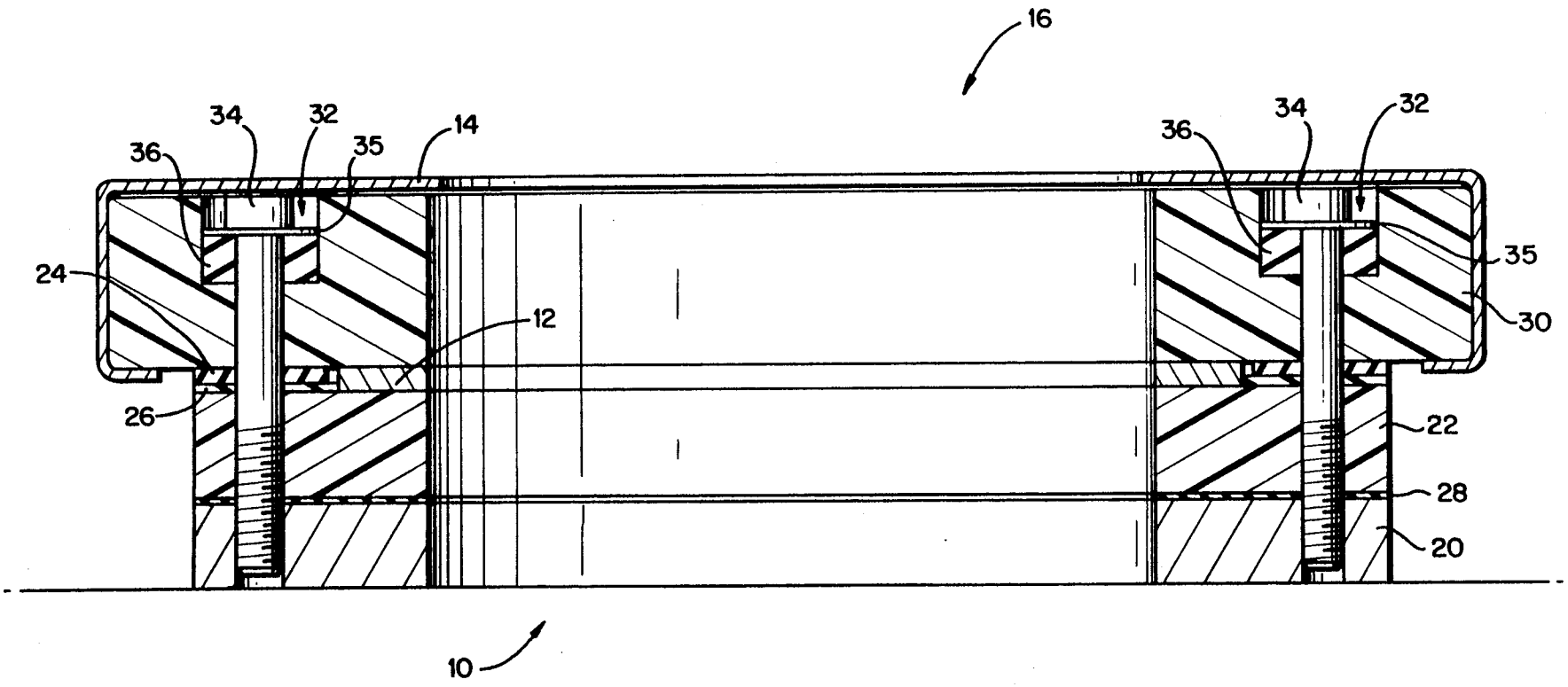
FIG. 6 is a cross sectional view taken along line 6—6 of FIG. 5.

The gate member 12 is slidingly mounted in a frame which is formed by a plate member 20, a lower base 22 and upper 24 and lower 26 gasket members, as shown in detail in FIG. 6. The upper gasket member 24 is of neoprene or similar material and serves to provide compression and sealing for the gate. The lower gasket 26 is of UHMW or similar material and serves as a guide as it fits in close proximity adjacent the gate 12. The lower base 22 is also of UHMW or a similar material. The gate 12 and dust cover 14, as well as the plate member 20, are formed of stainless steel or similar material. A gasket 28 of neoprene or similar material is positioned between plate member 20 and base 22.

Upwardly of the gate 12, an upper base 30 of UHMW or similar material provides an interior support for the dust cover 14. A plurality of cavities 32 along either side of the upper base member 30 provide space for mounting socket head screws 34 or similar securing members which extend downwardly through openings provided in the upper 30 and lower 22 bases, the upper 24 and lower 26 gaskets, as well as gasket 28 and plate 20, as shown in detail in FIG. 6.

A washer 36 of neoprene or a similar material is positioned in each cavity 32 so that the head of each socket head screw 34 impinges on a flat washer 35 and neoprene washer 36 as the screw 34 is tightened in threaded engagement with the plate 20 and base member 22.

A circular opening 16 for passage of particulate or other material is provided through the various members including the gate 12, dust cover 14 and members 20, 22 and 30 as shown in FIG. 6.

The gate assembly 10 is maintained in a dust tight condition by means of controlled compression. The bolts or screws 34 can be adjusted to vary the compression of the washer 36 and gasket member 24. The dust cover 14 provides additional sealing.

In one embodiment, some of the components are made of UHMW plastic which provides self-lubricating properties for ease of operation. The entire device may be advantageously constructed of materials approved for USDA, FDA and pharmaceutical operations.

As shown in FIG. 2, supports 40 and 42 are provided to hold the gate 12 and dust cover 14 when the components are pulled open and disassembled for washing. The gate 12 is completely removable for cleaning of the gate and slide area.

The pins 44 secured to the respective flanges 50, 52 of the gate 12 and dust cover 14 provide operating space and clearance for grippers or clamps which may be employed to operate the assembly 10 so as to open and close the gate 12, as described in U.S. Pat. application Ser. No. 476,574 filed Feb. 7, 1990 now U.S. Pat. No. 5,042,538 which is incorporated by reference. The pins 44 also serve to stop the gate 12 in the closed position.

Figure 4:
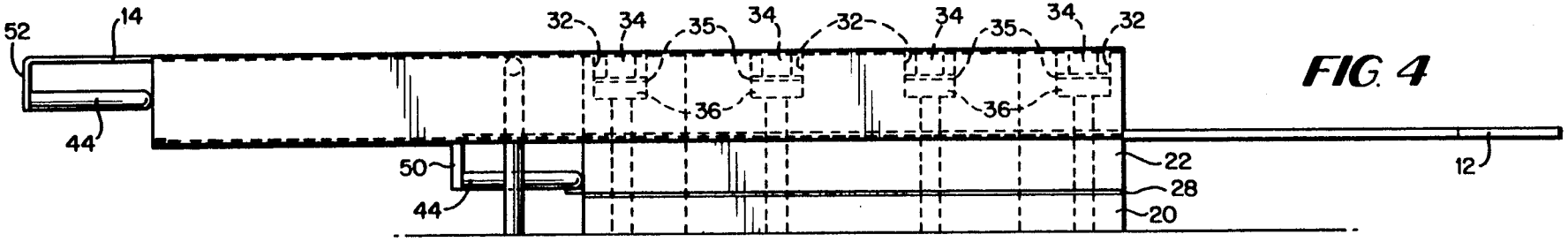
FIG. 4 is a side elevation showing the dust cover in the open position and the slide gate in the closed position.
Figure 5:
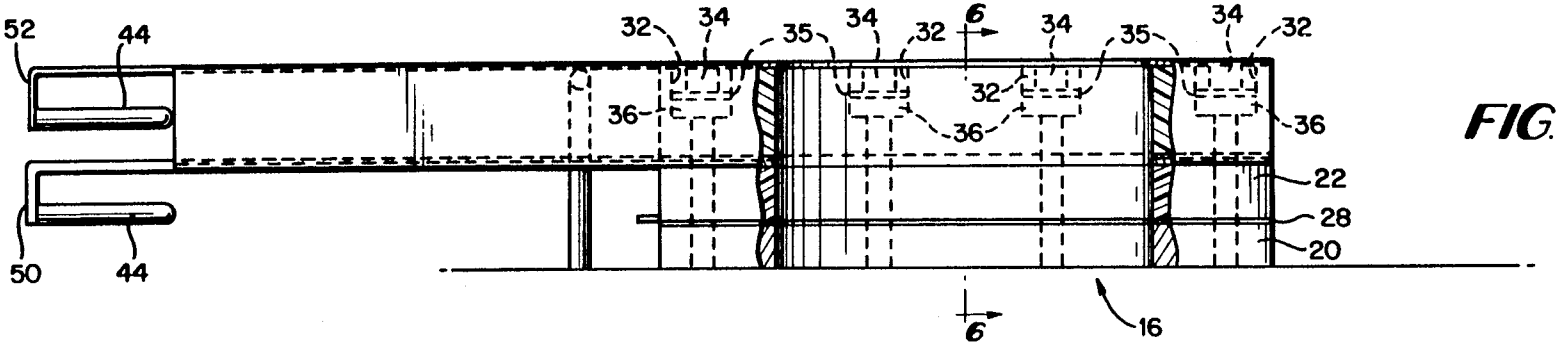
FIG. 5 is a side elevation showing the dust cover and the slide gate in the open position.

In the operation of the gate assembly 10, first the dust cover 14 is opened and a suitable vacuum is activated as necessary to clean the area. Then the openings are mated up and the gate 12 opens and allows material to flow through. As shown in FIG. 3, the dust cover 14 and gate 12 are closed. In FIG. 4, the dust cover 14 is opened and the gate 12 remains closed. The gate 12 is then opened so as to be aligned with the already open dust cover 14, as shown in FIG. 5, thus allowing material to pass through.

The gate 12 and dust cover 14 can be operated manually or automatically by mechanism means.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meanings and range of equivalency of the claims are therefore intended to be embraced therein.

What is claimed and desired to be secured by Letters Patent is:

1. A slide gate assembly for mounting on a bin or container to maintain a dust free environment, comprising:

an elongated frame having an opening therein and having upper and lower portions;

a gate member slidably mounted in said frame, said gate member having an opening for passage of material;

a dust cover slidably mounted in the upper portion of said frame; and means for providing compression and sealing for said gate member.

2. The slide gate assembly of claim 1 further including support means for holding said gate and dust cover in position during disassembly.

3. The slide gate assembly of claim 1 wherein pin members are mounted on said gate and said dust cover to provide operating space and clearance and also to act to stop said gate in the closed position.

4. A slide gate assembly for mounting on a bin or container to maintain a dust free environment, comprising:

an elongated frame having an opening therein and having resilient portions;

a gate member slidably mounted in said frame, said gate member having an opening for passage of material; and means for providing compression and sealing for said gate member, said compression and sealing means including a plurality of screw or bolt members which extend through the resilient portions of said frame to provide compression and sealing of said gate.

5. The slide gate assembly of claim 4 wherein each of said screw or bolt members is mounted with the head thereof located in a cavity within said frame, and wherein each of said heads of said screw or bolt members impinges on a washer positioned in each said cavity.

6. A slide gate assembly for mounting on a bin or container to maintain a dust free environment, comprising:

an elongated frame having an opening therein;

a gate member slidably mounted in said frame, said gate member having an opening for passage of material;

means for providing compression and sealing for said gate member; and upper and lower gasket members located adjacent said gate, with said lower gasket member fitting in close proximity adjacent said gate to serve as a guide and wherein said compression means passes through said upper gasket member to provide compression and sealing for said gate.

7. The slide gate assembly of claim 6 wherein said upper gasket member is formed of neoprene.

8. The slide gate assembly of claim 9 wherein said lower gasket member is formed of UHMW material.

9. A slide gate assembly for mounting on a bin or container to maintain a dust free environment, comprising:

an elongated frame having an opening therein;

a gate member slidably mounted in said frame, said gate member having an opening for passage of material;

means for providing compression and sealing for said gate member; and said frame including a plate member, a lower base member and an upper base member, wherein said gate is positioned between said upper and lower base members and with a gasket being positioned between said plate member and said lower base member.

* * * * *